US007228833B2

(12) United States Patent
Klotz

(10) Patent No.: US 7,228,833 B2
(45) Date of Patent: Jun. 12, 2007

(54) ROCKER SYSTEM FOR AN INTERNAL COMBUSTION ENGINE

(75) Inventor: James R Klotz, Clinton Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 324 days.

(21) Appl. No.: 10/721,623

(22) Filed: Nov. 25, 2003

(65) Prior Publication Data

US 2005/0109296 A1 May 26, 2005

(51) Int. Cl.
*F01L 1/18* (2006.01)

(52) U.S. Cl. ..... 123/90.39; 123/90.15; 123/90.16

(58) Field of Classification Search ..... 123/90.39, 123/90.15, 90.16
See application file for complete search history.

(56) References Cited

U.S. PATENT DOCUMENTS 3,531,234 A * 9/1970 Ravenel ..... 123/90.34
4,848,284 A * 7/1989 Konno ..... 123/90.16
4,913,104 A * 4/1990 Mills ..... 123/90.4
5,267,536 A * 12/1993 Imagawa et al. ..... 123/90.23
6,250,269 B1 * 6/2001 Kawasaki ..... 123/90.39
6,505,589 B1 1/2003 Hayman et al.
6,748,913 B2 * 6/2004 Nakayama ..... 123/90.21

* cited by examiner

*Primary Examiner*—Thomas Denion
*Assistant Examiner*—Zelalem Eshete
(74) *Attorney, Agent, or Firm*—Thomas A. Jurecko

(57) ABSTRACT

An improved rocker system for actuating valve lift events of an internal combustion engine is provided. The system includes a rocker arm and an actuator link with the actuator link arranged to be in constant driving engagement with the rocker arm and a camshaft. A rocker shaft is positioned in a cylinder head and oriented to have a rotational axis that is substantially perpendicular to a rotational axis of the camshaft and the rocker arm is arranged to be rotated about the rocker shaft and engage a valve to actuate valve lift events of the internal combustion engine.

4 Claims, 5 Drawing Sheets

ROCKER SYSTEM FOR AN INTERNAL COMBUSTION ENGINE

FIELD OF THE INVENTION

The present invention relates generally to a valve train for an engine, and, more particularly, to an improved valve train rocker system arrangement for a push rod internal combustion engine.

BACKGROUND OF THE INVENTION

In a conventional V-style push rod internal combustion engine, a camshaft is located in the block at a center of the V shape. This camshaft location in combination with a single rocker shaft system draws elements of a valve train towards a center of the engine. This, in turn, generally results in the use of a wedge-shaped combustion chamber to accommodate the positioning and movement of the valves. More particularly, such conventional rocker shaft arrangements make it difficult to employ a more desirable spherical combustion chamber.

In addition, conventional valve train arrangements may also include two rocker shafts in the cylinder head, one shaft for an intake rocker arm and one shaft for an exhaust rocker arm, in order to utilize a spherical combustion chamber design. Generally, such a configuration can result in a relatively wide cylinder head design, add extra weight to the engine and can also create packaging challenges in a crowded underhood environment of today's automotive vehicles.

Thus, there is a need for an improved rocker system for a push rod internal combustion engine that overcomes the aforementioned and other disadvantages.

SUMMARY OF THE INVENTION

Accordingly, an improved rocker system for actuating valve lift events of an internal combustion engine is provided. The system includes a rocker arm and an actuator link that is in constant driving engagement with the rocker arm and a camshaft. A rocker shaft is positioned in a cylinder head and oriented to have a rotational axis that is substantially perpendicular to a rotational axis of the camshaft and the rocker arm is arranged to be rotated about the rocker shaft and engage a valve to actuate valve lift events of the internal combustion engine.

In accordance with one aspect of the present invention, a rocker system for actuating valve lift events of an internal combustion engine is provided with a rocker arm that is arranged to rotate about the rocker shaft and drivingly engage more than one valve.

In accordance with yet another aspect of the present invention, the actuator link includes a push rod and the rocker system for actuating valve lift events of the internal combustion engine is provided with a rocker shaft that includes a rotational axis oriented substantially parallel to a cylinder block deckface.

BRIEF DESCRIPTION OF THE DRAWINGS

Other aspects, features, and advantages of the present invention will become more fully apparent from the following detailed description of the preferred embodiment, the appended claims, and in the accompanying drawings in which:

DETAILED DESCRIPTION OF THE PREFERRED EMBODIMENT

Figure 1:
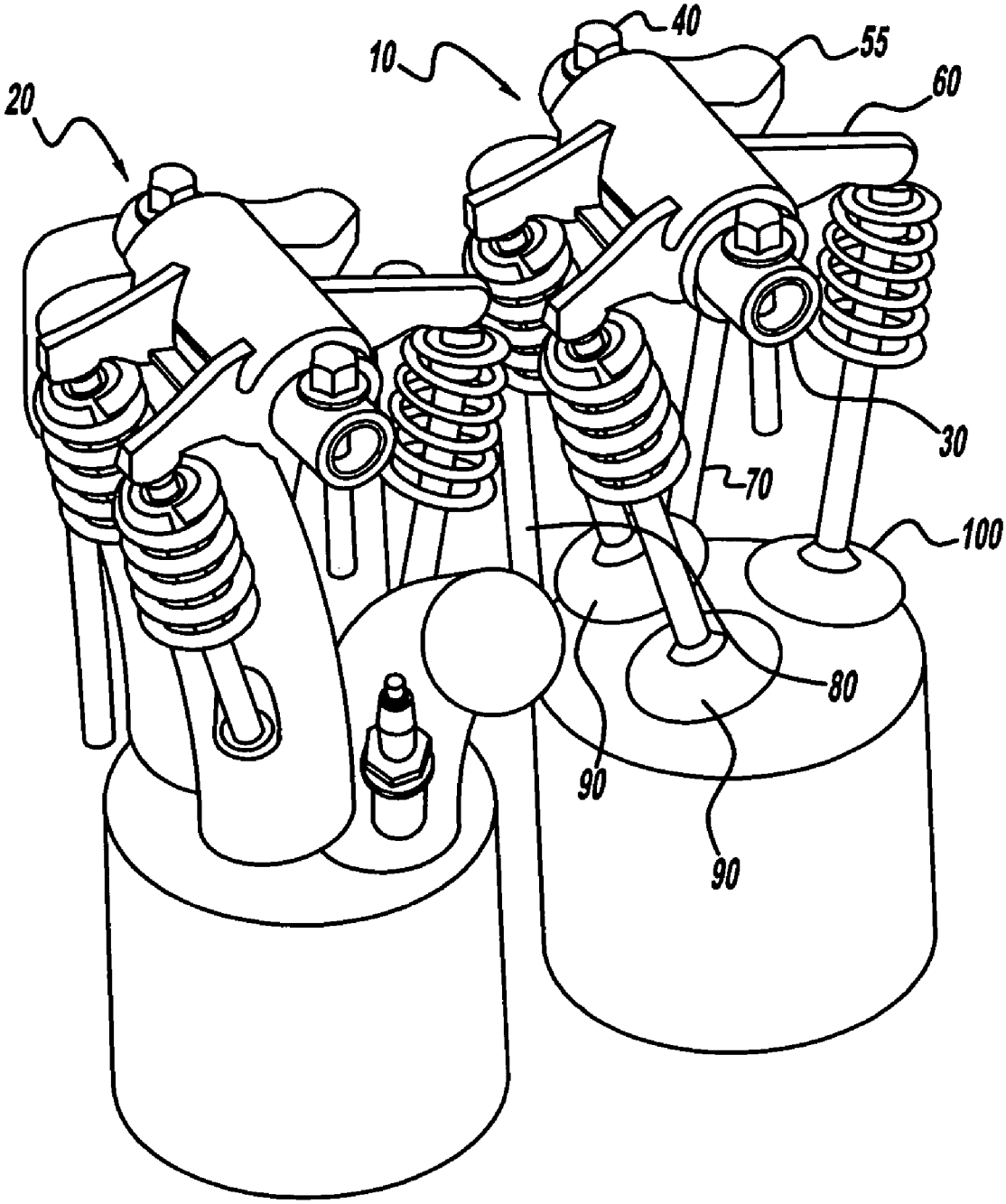
FIG. 1 illustrates a perspective view of an articulated rocker system in accordance with the present invention.
Figure 2:
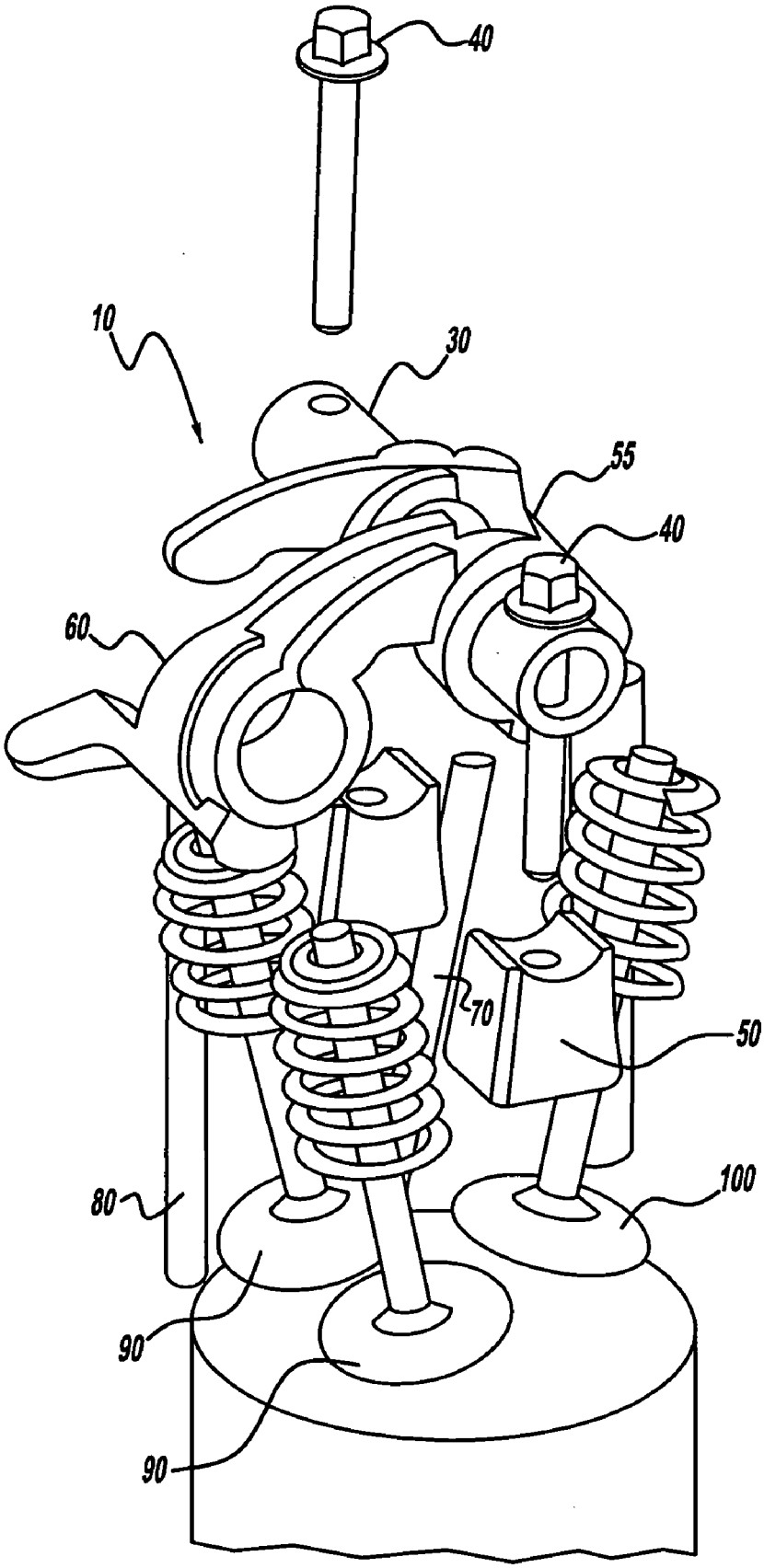
FIG. 2 illustrates an exploded view of the rocker system components in accordance with the present invention.

Referring now to the drawings, FIGS. 1 and 2 illustrate an exemplary embodiment of an articulated rocker system 10 for a V-style push rod internal combustion engine in accordance with the present invention. It should be appreciated that specific details of well known features have not been shown and/or described so as not to obscure the present invention. In addition, articulated rocker system 20 is a duplicate of system 10 and is illustrated to provide additional perspective into the compact nature and improved packaging ability of the rocker system according to the present invention for each cylinder of a V-style internal combustion engine.

As best shown in FIGS. 1 and 2, rocker system 10 includes a shaft 30 which is rotated substantially 90 degrees from conventional positioning in a cylinder head. More specifically, in a conventional rocker system, the rocker shaft axis of rotation is oriented to be parallel to an axis of rotation of a camshaft, not substantially perpendicular to the axis of rotation of the camshaft as with the present invention. Rocker shaft 30 is secured with bolt 40 to cylinder head pedestals 50 which are shown in FIG. 2 without the corresponding cylinder head structure.

In the exemplary embodiment, intake rocker arm 55 and exhaust rocker arm 60 are positioned on and pivot about a central axis provided by rocker shaft 30. It should be appreciated that while the articulated rocker system 10 is shown illustrating a three-valve system, intake rocker arm 55 could also be configured to engage only a single intake valve for a two-valve system arrangement. Rocker arms 55 and 60 are each in rotation engagement with shaft 30 and do not rotationally interfere with each other while pivoting about rocker shaft 30 during normal engine operation. More specifically, as best shown in FIG. 2, intake rocker arm 55 is slotted or otherwise formed to allow exhaust rocker arm 60 to coupled about rocker shaft 30 but nested within intake rocker arm 55. Intake rocker arm 55 is in constant driving engagement with intake push rod 70 and intake valves 90, and exhaust rocker 60 is in constant driving engagement with exhaust push rod 80 and exhaust valve 100. It should also be appreciated that while the drawings illustrate intake and exhaust push rods, it is contemplated by this invention that other actuator links could be used in place of push rods such as a cam roller follower.

Figure 3:
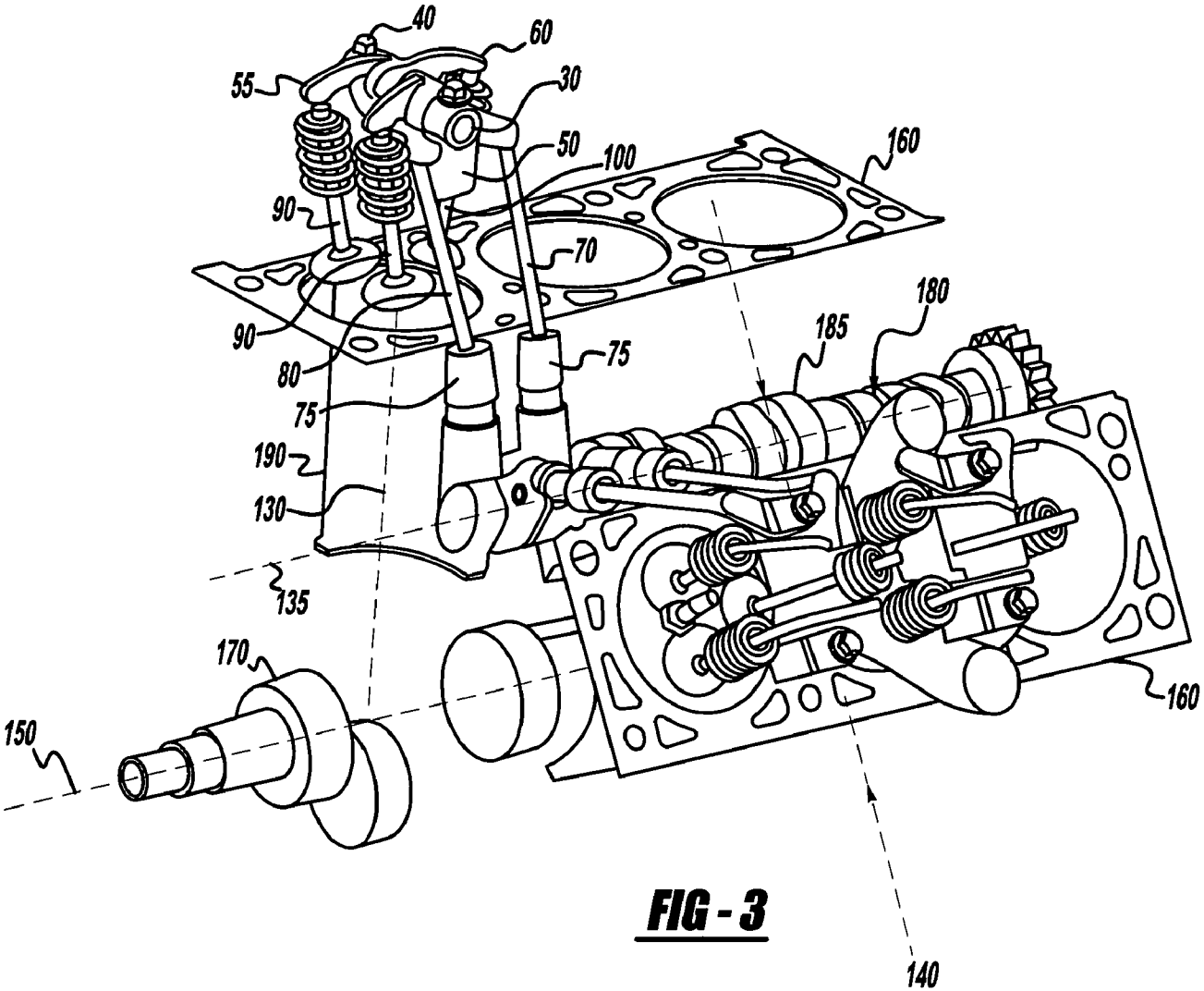
FIG. 3 illustrates a cut away perspective view of an internal combustion engine with a rocker system in accordance with the present invention.

Referring now to FIG. 3, a cut away view of an internal combustion engine is shown having a rocker system in accordance with the present invention. FIG. 3 illustrates a crankshaft 170 having an axis of rotation 150 and a camshaft 180 having a parallel axis of rotation 135. Also illustrated is a partial view of a cylinder block deckface 160 and a cylinder wall section 190.

In operation and referring to FIG. 3, rotation of crankshaft 170 in turn rotates camshaft 180 along axis of rotation 135 via a drive mechanism such as a chain drive (not shown). Camshaft 180 carries a plurality of intake and exhaust cam lobes denoted generally as 185 which are in constant rotational engagement with cam followers 75. Rotation of the camshaft 180 actuates cam followers 75 via intake or exhaust cam lobes 185 and raises the respective intake push rod 70 or exhaust push rod 80. Raising the intake or exhaust push rod in turn rotates the respective intake rocker arm 55 or exhaust rocker arm 60 about rocker shaft 30. Both the intake and exhaust rocker arms rotate about common rocker shaft 30 with axis of rotation 140 which is substantially perpendicular to camshaft axis of rotation 135.

Intake rocker arm 55 is in constant driving engagement with intake valves 90 and intake push rod 70. Rotation of intake rocker arm 55 about rocker shaft 30 actuates intake valves 90 for performing intake valve lift events of the internal combustion engine. Likewise, exhaust rocker arm 60 is in constant driving engagement with exhaust valve 100 and exhaust push rod 80. Rotation of exhaust rocker arm 60 about rocker shaft 30 actuates exhaust valve 100 for performing exhaust valve lift events of the engine.

Figure 4:
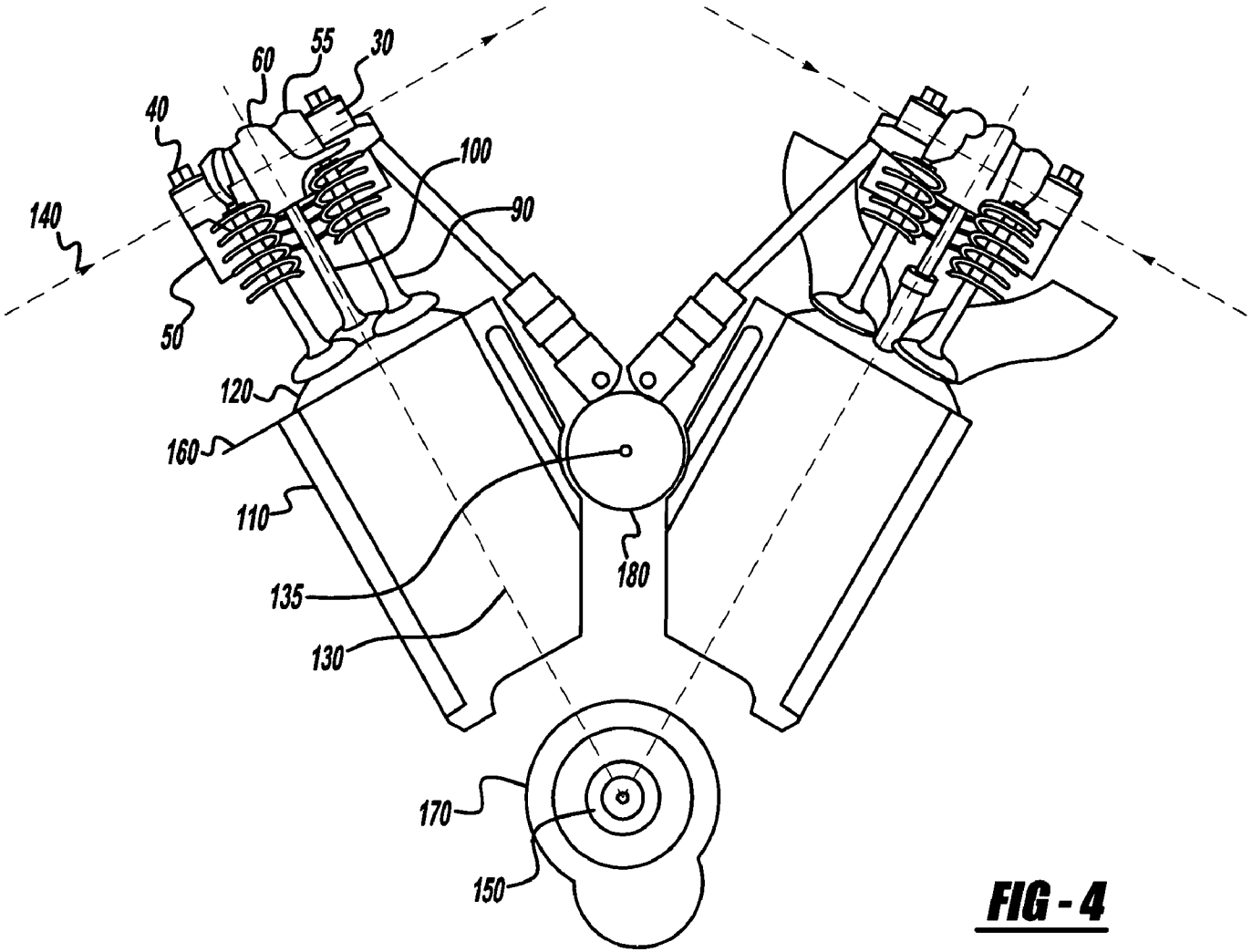
FIG. 4 illustrates a front view of FIG. 3 looking along a camshaft axis of rotation in accordance with the present invention.

FIG. 4 illustrates a front view of FIG. 3 looking into camshaft axis of rotation 135. FIG. 4 shows a symmetrical relationship of intake valves 90 and exhaust valve 100 about a centerline 130 of cylinder 110. In addition, rocker shaft 30's axis of rotation 140 is shown having a parallel relationship to a cylinder block deckface 160. In accordance with one aspect of the present invention, configuring rocker shaft 30's axis of rotation 140 to be perpendicular to camshaft 180's axis of rotation 135 while also being parallel to cylinder block deckface 160 in combination with the symmetrical relationship of intake and exhaust valves about cylinder centerline 130 provides the ability to use a spherical combustion chamber in the cylinder head with a compact rocker system in accordance with the present invention.

Figure 5:
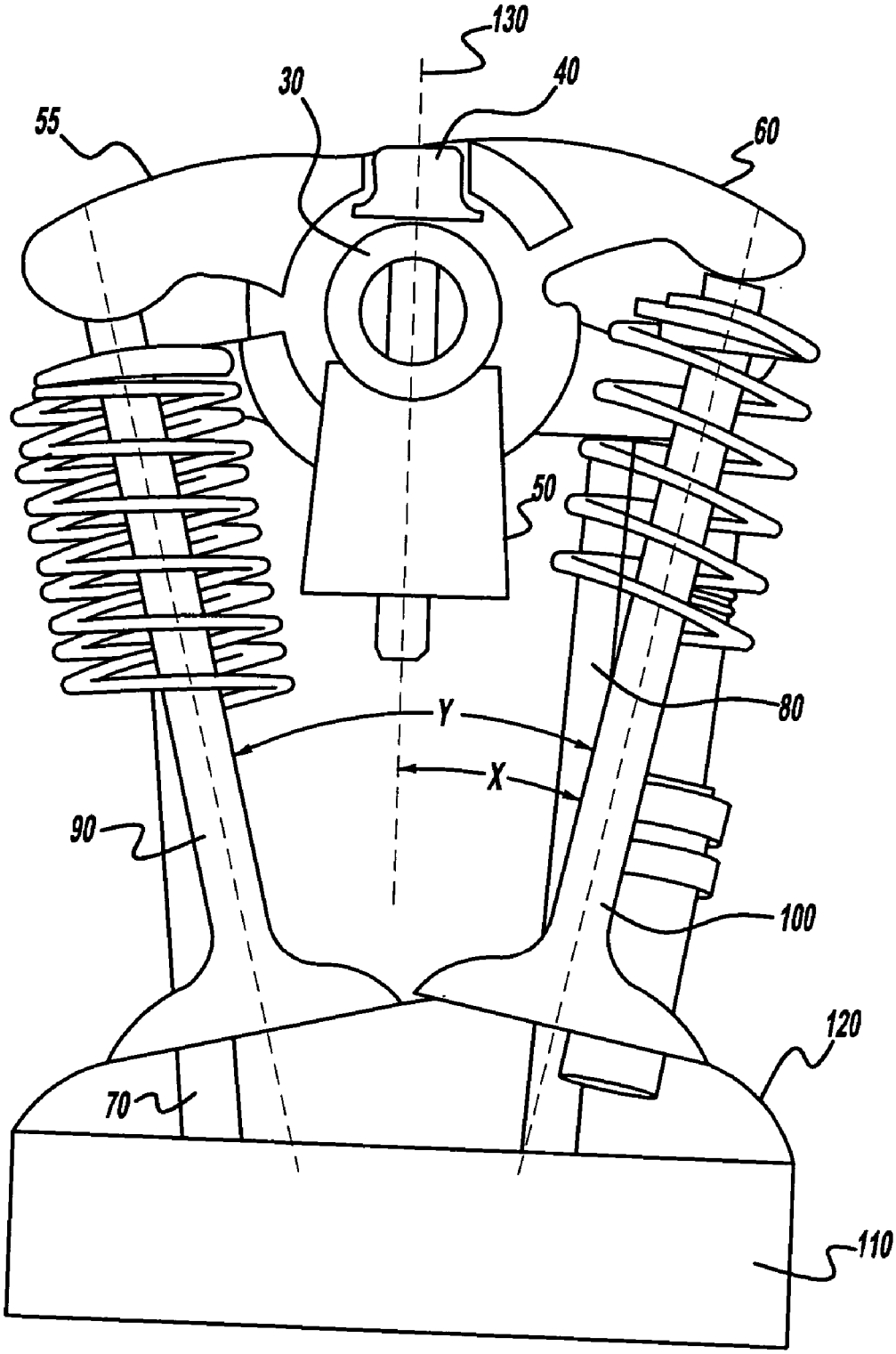
FIG. 5 illustrates a side view of the rocker system along a rocker shaft axis of rotation in accordance with the present invention.

Referring now to FIG. 5, a relationship of intake valves 90 and exhaust valve 100 to cylinder 110 and cylinder centerline 130 is shown looking into rocker shaft 30 along its axis of rotation 140. It should be appreciated that with a common axis of rotation for the intake and exhaust rockers along with a spherical combustion chamber design, valve angles X and Y could be increased thereby allowing for larger valve head diameters. Increasing the valve angle also provides the ability to shorten the valve stem length which, in turn, will also decrease the mass of the valve.

In addition, by using a rocker system arrangement in accordance with the principles of the present invention, valve stem length as well as pushrod length can be decreased thereby increasing the rocker system efficiency by reducing the rocker system mass. Furthermore, the rocker system arrangement of the present invention allows for efficient packaging of each cylinder's respective rocker system, especially for a three-valve per cylinder arrangement. More specifically and referring to FIG. 1, exhaust rocker arm 60 of rocker system 20 can be positioned in close proximity to rocker system 10 of an adjacent cylinder because exhaust rocker arm 60 of rocker system 20 can utilize open space between split intake rocker arm 55 of rocker system 10. Thus, the rocker system of the present invention also provides for an optimized cylinder head design that is both more compact and lighter in weight.

The foregoing description constitutes the embodiments devised by the inventors for practicing the invention. It is apparent, however, that the invention is susceptible to modification, variation, and change that will become obvious to those skilled in the art. Inasmuch as the foregoing description is intended to enable one skilled in the pertinent art to practice the invention, it should not be construed to be limited thereby but should be construed to include such aforementioned obvious variations and be limited only by the proper scope or fair meaning of the accompanying claims.

What is claimed is:

1. A rocker system for actuating valve lift events of an internal combustion engine, the rocker system comprising:

a rocker arm;

an actuator link in constant driving engagement with the rocker arm and a camshaft;

a rocker shaft positioned in a cylinder head and oriented to have a rotational axis substantially perpendicular to a rotational axis of the camshaft, wherein the rocker arm is arranged to be rotated about the rocker shaft and engage a valve to actuate valve lift events of the internal combustion engine;

wherein the rocker arm includes:

an intake rocker arm arranged to rotate about the rocker shaft; and an exhaust rocker arm arranged to rotate about the rocker shaft, wherein the exhaust rocker arm is coupled about the rocker shaft so as to be nested within the intake rocker arm while allowing independent rotation of the intake and exhaust rocker arms.

2. The rocker system of claim 1, wherein the actuator link comprises a push rod.

3. The rocker system of claim 1, wherein the intake rocker arm is arranged to rotate about the rocker shaft and drivingly engage more than one valve.

4. The rocker system of claim 1, wherein the rotational axis of the rocker shaft is oriented to be substantially parallel to a cylinder block deckface.

* * * * *